US012616266B1

(12) United States Patent
Milot, III

(10) Patent No.: US 12,616,266 B1
(45) Date of Patent: May 5, 2026

(54) QUICK-RELEASE HEADBAND RATCHET MECHANISM

(71) Applicant: Protective Industrial Products, Inc., Latham, NY (US)

(72) Inventor: Joseph Anthony Milot, III, Albany, NY (US)

( * ) Notice: Subject to any disclaimer, the term of this patent is extended or adjusted under 35 U.S.C. 154(b) by 0 days.

(21) Appl. No.: 19/173,915

(22) Filed: Apr. 9, 2025

(51) Int. Cl.
*A42B 3/14* (2006.01)
*A42B 3/08* (2006.01)

(52) U.S. Cl.
CPC ..... *A42B 3/145* (2013.01); *A42B 3/085* (2013.01)

(58) Field of Classification Search
CPC ..... A42B 3/145; A42B 3/14; A42B 3/085; A42B 1/22; A41D 13/1161; A41D 13/1184
See application file for complete search history.

(56) References Cited

U.S. PATENT DOCUMENTS

| | | | | |
|---|---|---|---|---|
| 4,888,831 | A | 12/1989 | Oleson | |
| 5,950,245 | A | 9/1999 | Binduga | |
| 7,000,262 | B2 | 2/2006 | Bielefeld | |
| 11,771,168 | B2 | 10/2023 | Huh et al. | |
| 2008/0184451 | A1* | 8/2008 | Lemke | A42B 3/145 2/418 |
| 2009/0211385 | A1* | 8/2009 | Fiquepron | A42B 3/145 74/422 |
| 2015/0059065 | A1* | 3/2015 | Klotz | A42B 3/145 2/418 |
| 2020/0121017 | A1* | 4/2020 | King | A42B 3/14 |
| 2020/0213708 | A1* | 7/2020 | Wang | H04R 1/1066 |
| 2021/0337908 | A1 | 11/2021 | Pracht et al. | |
| 2025/0107586 | A1* | 4/2025 | He | A42B 3/085 |

* cited by examiner

*Primary Examiner* — Patrick J. Lynch
*Assistant Examiner* — Brianna T. Duckworth
(74) *Attorney, Agent, or Firm* — Hooker & Habib, P.C.

(57) ABSTRACT

A headband ratchet mechanism for tightening/loosening the headband of a safety helmet is operated by a knob that rotates in tightening and loosening directions to tighten or loosen the headband about the head of a wearer of the safety helmet. A ratchet mechanism resists loosening of the headband during normal use of the safety helmet. A quick-release mechanism actuatable by the wearer enables headband tension to be relieved without rotating the knob.

17 Claims, 18 Drawing Sheets

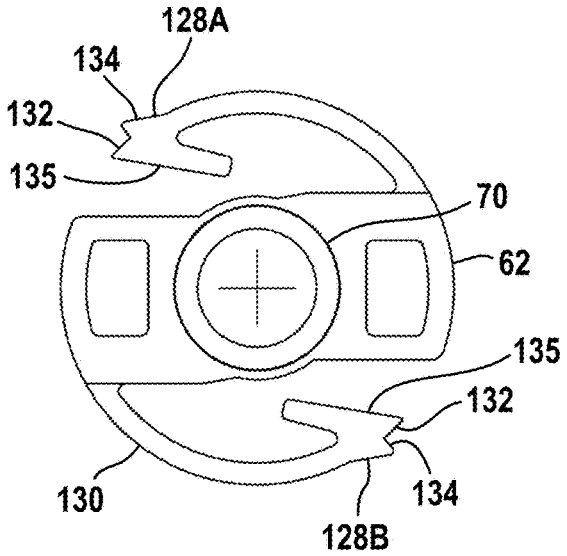
FIG. 32
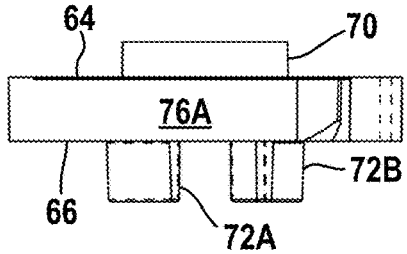
FIG. 33
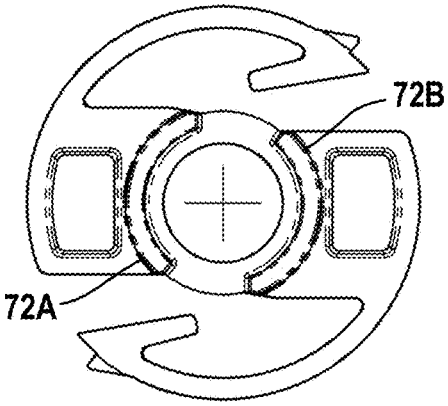
FIG. 34
FIG. 30
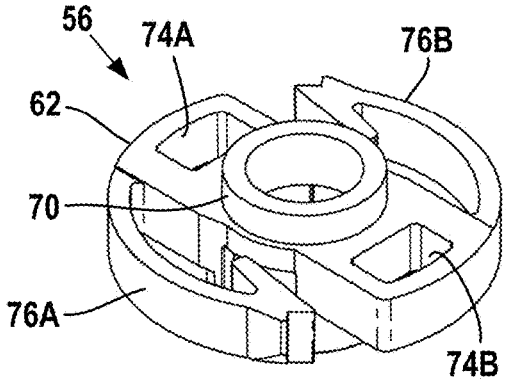
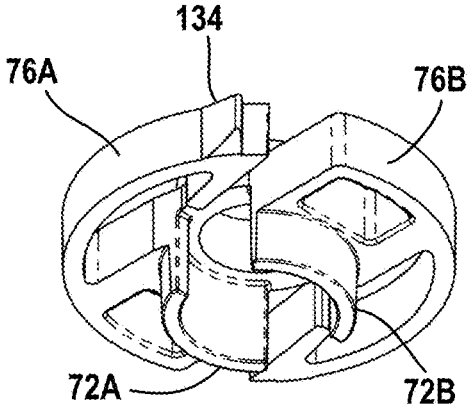
FIG. 31

QUICK-RELEASE HEADBAND RATCHET MECHANISM

FIELD OF THE DISCLOSURE

This disclosure relates to safety helmets having a headband, and in particular, to headband adjustment mechanisms that enable the wearer of the safety helmet to adjust the length of the headband.

BACKGROUND OF THE DISCLOSURE

Safety helmets (also known as hard hats) are protective headgear that protect workers from injury from falling objects or other hazards. The safety helmet is secured to the head by a headband suspended by the safety helmet that goes around the head of the wearer. The fit of the headband can be adjusted by a headband adjustment mechanism having an exposed knob that can be rotated in opposite directions to tighten or loosen the headband.

The knob drives a pinion gear P (see FIG. 66) that engages rack teeth formed in opposite end portions H1, H2 of the headband as shown in FIG. 66. An example of a headband ratchet mechanism for a safety helmet is disclosed in Binduga, U.S. Pat. No. 5,950,245.

There is a need for an improved headband adjustment mechanism that enables the quick-release of headband tension without rotating the knob but also functions to resist lengthening of the headband while the knob is stationary and not being used by the user to lengthen or shorten the headband.

SUMMARY OF THE DISCLOSURE

Disclosed is an improved headband adjustment mechanism for a safety helmet that enables the quick-release of headband tension without rotating the knob but also functions to resist lengthening of a tightened headband while the knob is stationary and not being used by the wearer of the safety helmet to lengthen or shorten the headband.

An embodiment of an improved headband adjustment mechanism formed as a quick-release headband ratchet mechanism in accordance with this disclosure includes a pinion gear rotatable about an axis of rotation in a tightening and loosening direction and an exposed knob normally non-rotatably connected to the pinion gear that enables a user to selectively rotate the pinion gear in the tightening or loosening direction. A ratchet mechanism includes a ratchet gear and a ring gear. The ratchet gear is non-rotatably connected to the pinion gear for conjoint rotation with the pinion gear. The ratchet gear is normally surrounded by the stationary ring gear having ratchet teeth disposed about a body of the ratchet gear. The ratchet gear includes at least one elastically resilient pawl arm extending from the ratchet gear body radially away from the body and circumferentially in the loosening direction of rotation. The resiliency of the pawl arm normally urges the free end of the pawl arm against the ratchet teeth. While the knob is stationary, force applied to the pinion gear by a tightened headband urging the pinion gear to rotate in the loosening direction is resisted by the free end of the pawl arm engaging a steep side of a ratchet gear tooth, resisting and preventing the pinion gear from continued rotation in the loosening direction.

The knob is normally non-rotatably connected to the ratchet gear by at least one drive member extending parallel with the axis of rotation and associated with a respective pawl arm. The drive member is received between the respective pawl arm and the ratchet gear body. Rotation of the knob in the tightening direction forces the drive member against an end of the respective pawl arm and drives the ratchet gear in the tightening direction. The free end of the respective pawl arm slides over the opposite less step sides of the ratchet gear teeth enabling rotation of the ratchet gear in the tightening direction. Rotation of the knob in the loosening direction engages the drive member against the opposite end of the pawl arm that applies a force to the free end of the pawl arm moving the free end of the pawl arm radially inwardly and out of engagement with the ring gear teeth enabling rotation of the ratchet gear in the loosening direction.

The embodiment of the quick-release headband ratchet mechanism further includes a release mechanism that selectively releases the pinion gear from the knob, enabling the pinion gear to "free-wheel" and rotate in the loosening direction in response to force applied to the pinion gear by a tightened headband. An embodiment of the release mechanism includes a torque transmission member disposed between the knob and the ratchet gear. The torque transmission member has teeth that meshably engage with knob teeth to selectively non-rotatably connect the torque transmission member and the knob. The torque transmission member in this embodiment carries the at least one drive members.

The torque transmission member and the ratchet gear are both movably mounted with respect to the axis of rotation. A spring urges the ratchet gear and the torque transmission member to a first, normal operating position in which the teeth of the knob and torque transmission mesh with one another and the ratchet gear is surrounded by the ring gear. An exposed actuator enables a user to push the ratchet gear and the torque transmission member to a second operating position in which the torque transmission member is spaced apart from the knob and the ratchet gear is moved out of the ring gear. The pinion gear can freewheel in response to headband tension to loosen the headband.

An embodiment of the torque transmission member is a face gear having serrated teeth that face complementary serrated teeth of the knob. In yet other embodiments the ratchet gear can form a portion of the torque transmission member. If the quick-release mechanism is not included in embodiments of the disclosed headband ratchet mechanism, the ratchet gear can include the features of the face gear and can be axially fixed with respect to the axis or rotation.

Other objects and features of the disclosure will become apparent as the description proceeds, especially when taken in conjunction with the accompanying drawing sheets illustrating one or more illustrative embodiments.

BRIEF DESCRIPTION OF THE DRAWINGS

FIGS. 30 and 31 are top-side and bottom-side perspective views respectively of the ratchet gear of the quick-release headband ratchet mechanism.

FIGS. 32, 33, and 34 are top, front, and bottom views respectively of the ratchet gear.

DETAILED DESCRIPTION

FIGS. 1-11 illustrate an embodiment of a headband adjustment quick-release ratchet mechanism 10 for a safety helmet (not shown) in accordance with this disclosure. The headband quick-release ratchet mechanism utilizes a pinion gear connected to a pinion gear drive (described in more detail below). The pinion gear drive incorporates a ratchet mechanism that enables the pinion gear drive:

(a) to drive the pinion gear in a tightening direction that shortens (tightens) the headband;

(b) to drive the pinion gear in a loosening direction that lengthens (loosens) the headband; and (c) to resist lengthening of the headband when the pinion gear drive is not being used by the user to lengthen or shorten the headband.

The quick-release ratchet mechanism further includes a release mechanism that selectively connects and disconnects the ratchet mechanism from the pinion gear drive. When the ratchet mechanism is connected to the pinion gear drive, the pinion gear can be rotated by the user in the tightening or loosening direction. When the ratchet mechanism is disconnected from the pinion gear drive, the pinion gear can free-wheel and rotate in the loosening direction in response to headband tension.

Figure 19:
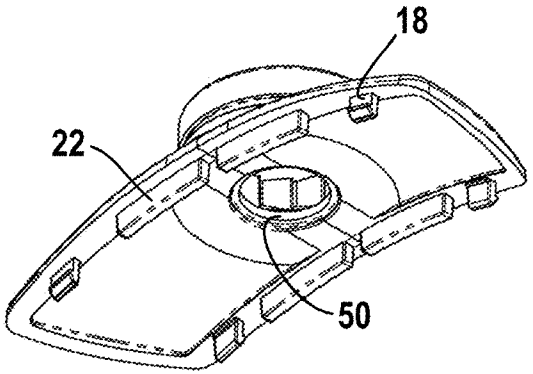
Figure 12:
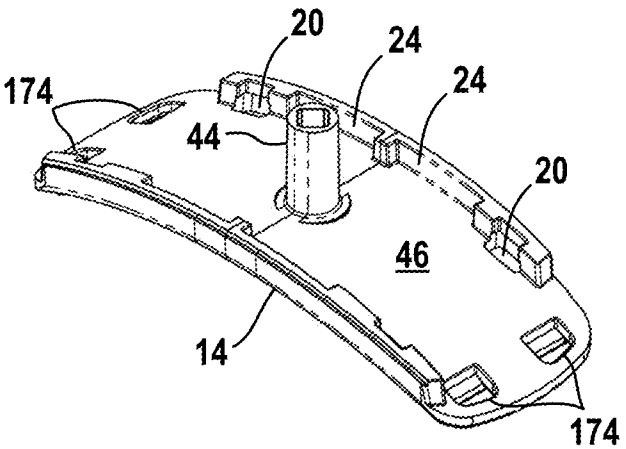
FIGS. 12 and 13 are top-side and bottom-side perspective views respectively of the base of the quick-release headband ratchet mechanism.
Figure 13:
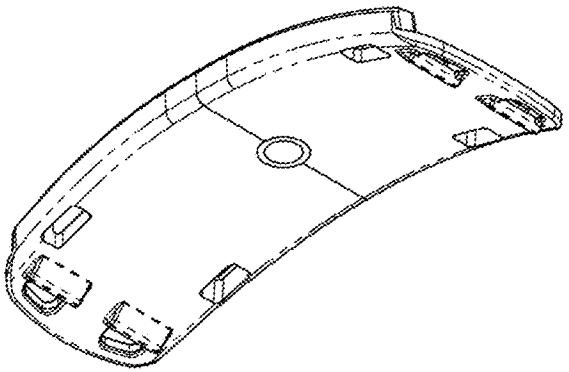
Figure 17:
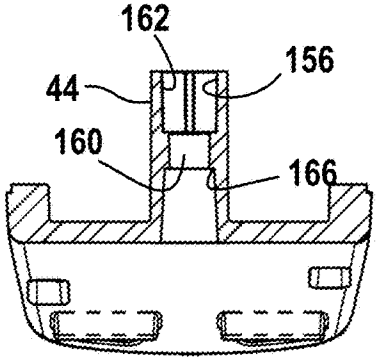
FIG. 17 is a sectional view of the base taken along line 17-17 of FIG. 15.
Figure 16:
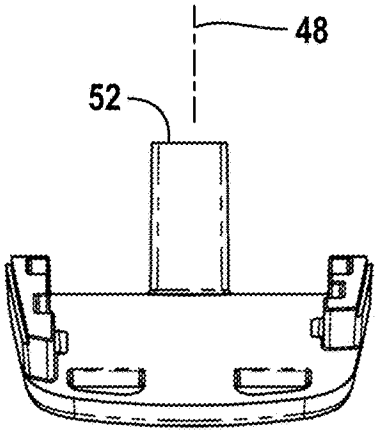
FIGS. 14, 15, and 16 are top, front, and side views respectively of the base.
Figure 14:
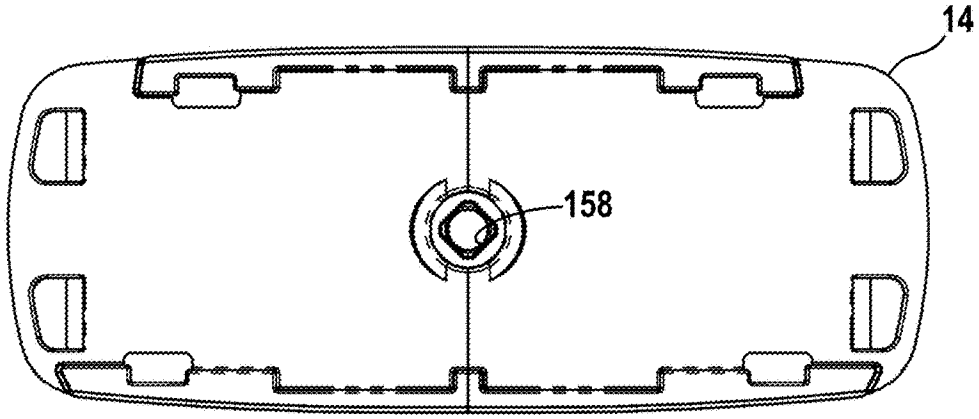
Figure 15:
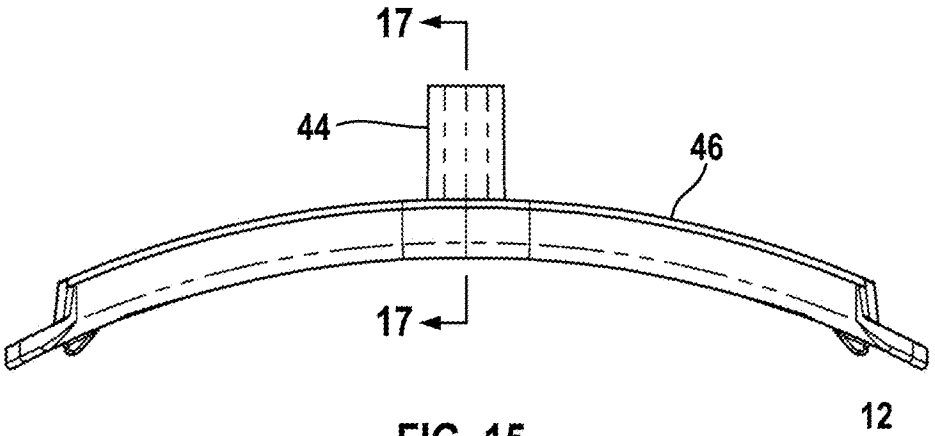
Figure 20:
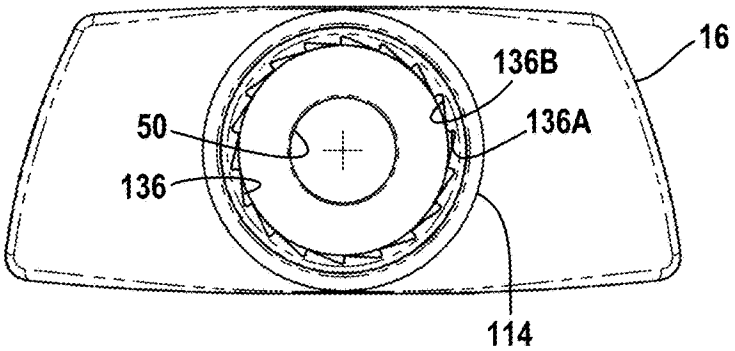
FIGS. 20, 21, 22, and 23 are top, front, side, and bottom views respectively of the cover.
Figure 22:
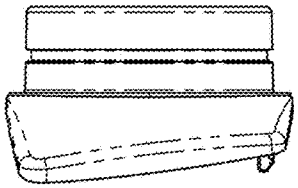
Figure 24:
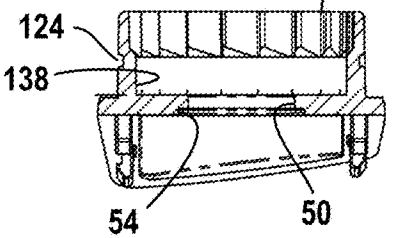
FIG. 24 is a sectional view of the cover taken along line 24-24 of FIG. 21.
Figure 21:
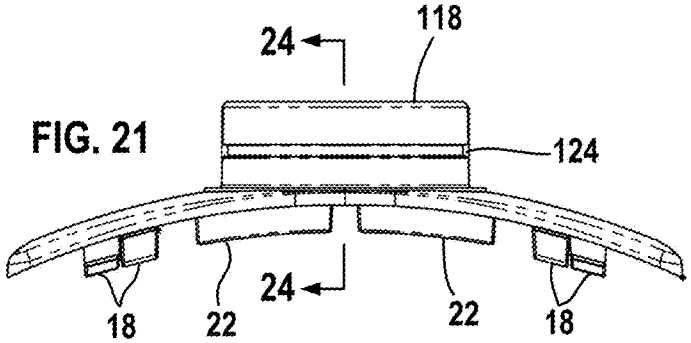
Figure 23:
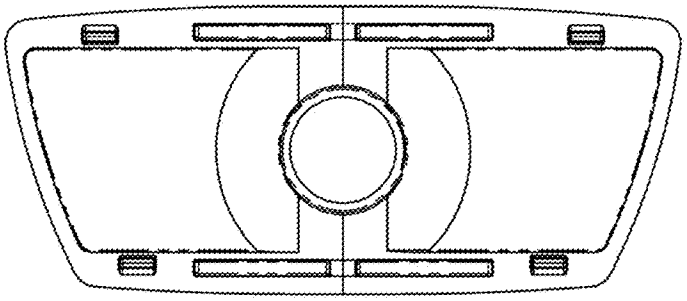
Figure 27:
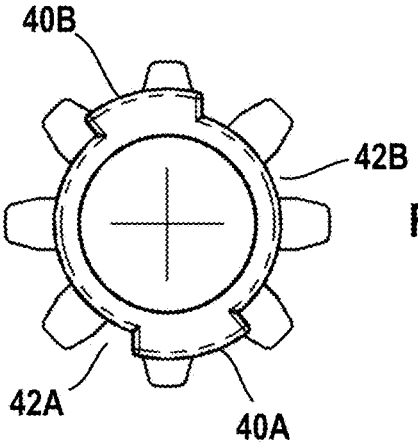
FIGS. 27, 28, and 29 are top, front, and bottom views respectively of the pinion member.
Figure 25:
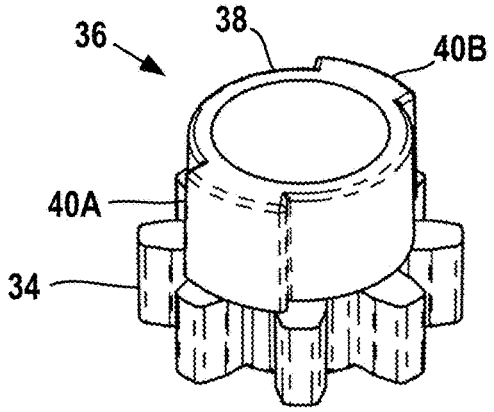
FIGS. 25 and 26 are top-side and bottom-side perspective views respectively of the pinion member of the quick-release headband ratchet mechanism.
Figure 28:
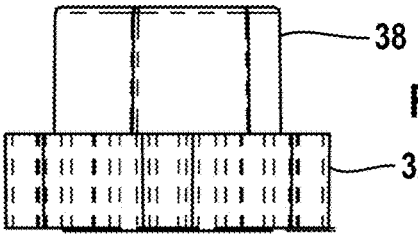
Figure 26:
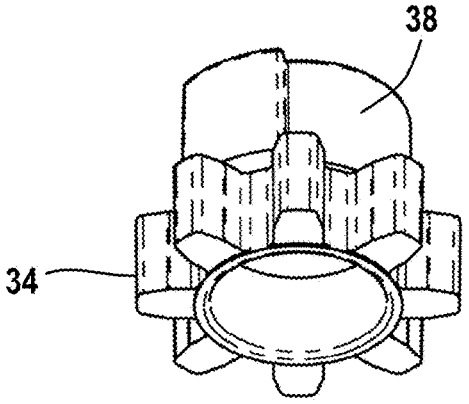
Figure 29:
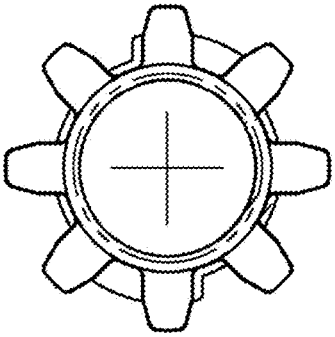
Figure 36:
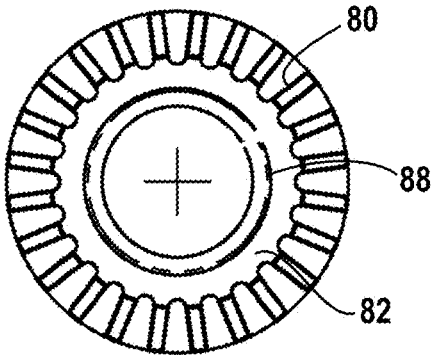
FIGS. 36, 37, 38, and 39 are top, front, side, and bottom views respectively of the face gear.
Figure 35:
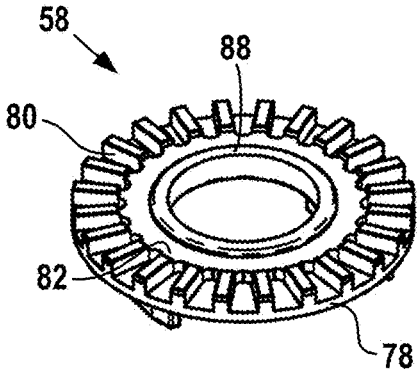
FIG. 35 is a top-side perspective view of the face gear of the quick-release headband ratchet mechanism.
Figure 37:
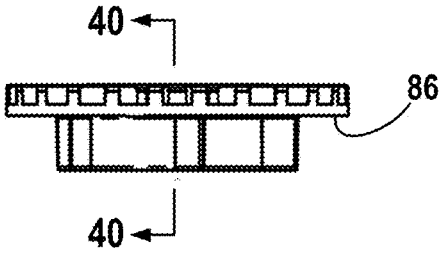
Figure 38:
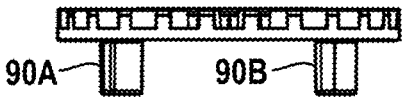
Figure 39:
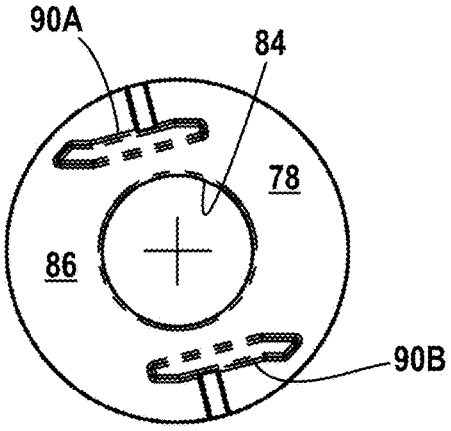
Figure 40:
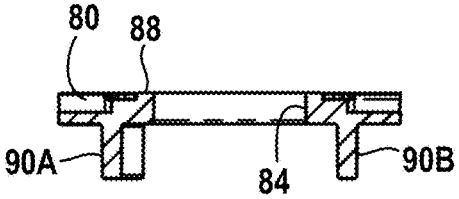
FIG. 40 is a sectional view of the face gear taken along line 40-40 of FIG. 37.
Figure 41:
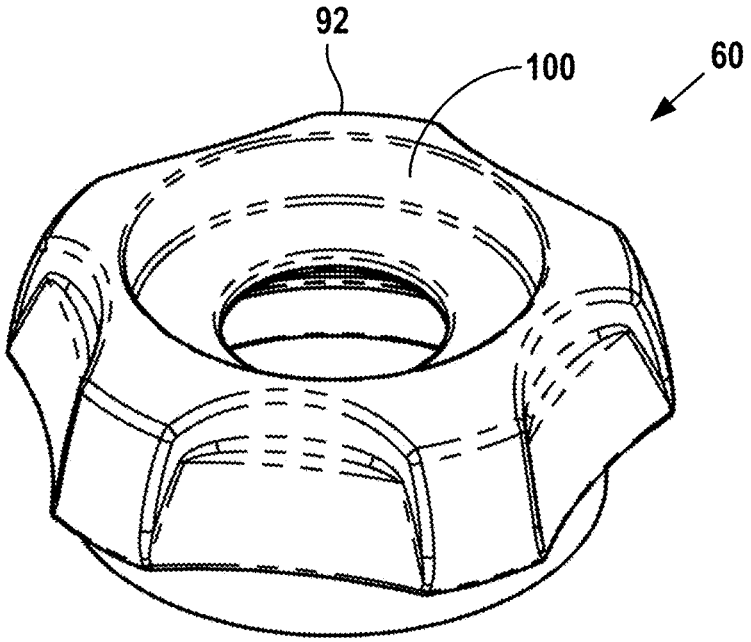
FIGS. 41 and 42 are top-front and bottom-front perspective views respectively of the knob of the quick-release headband ratchet mechanism.
Figure 42:
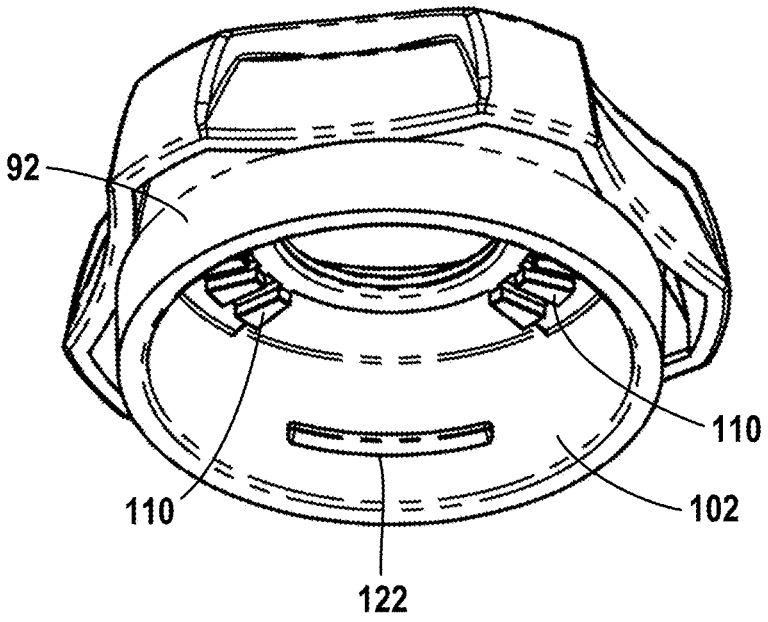
Figure 43:
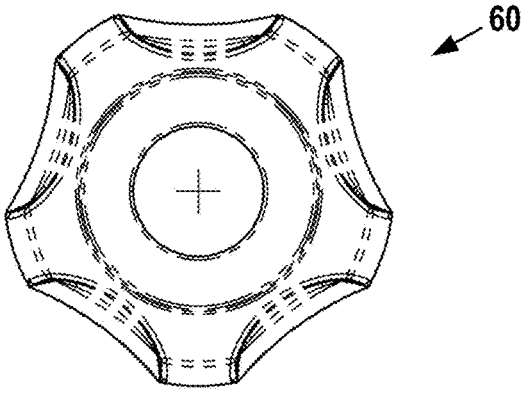
FIGS. 43, 44, 45, and 46 are top, front, side, and bottom views respectively of the knob.
Figure 47:
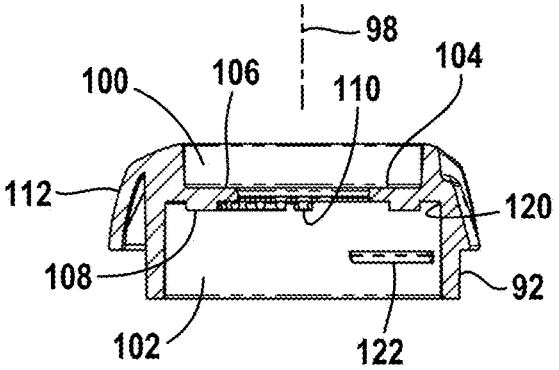
FIG. 47 is a sectional view of the knob taken along line 47-47 of FIG. 44.
Figure 44:
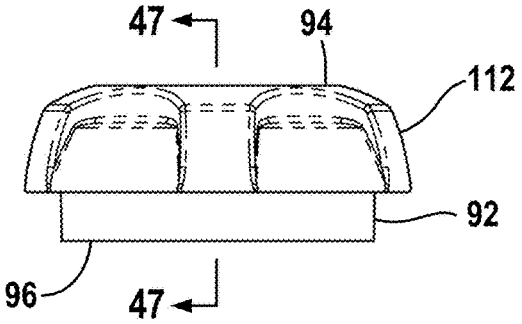
Figure 45:
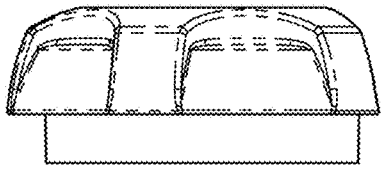
Figure 46:
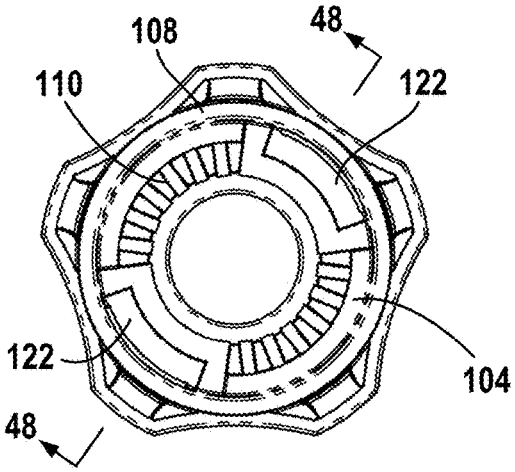
Figure 48:
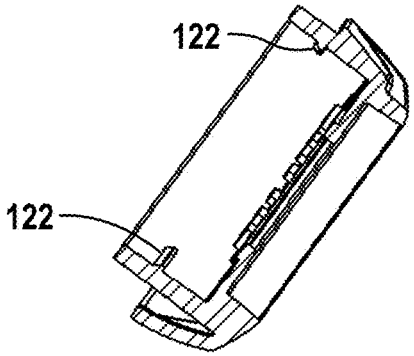
FIG. 48 is a sectional view of the knob taken along line 48-48 of FIG. 46.
Figure 49:
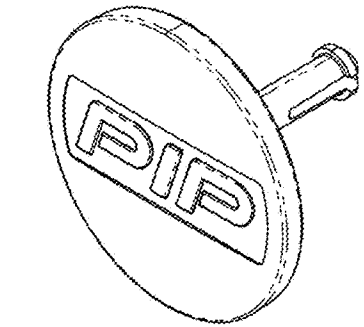
FIGS. 49 and 50 are top-side and bottom-side perspective views respectively of the release actuator of the quick-release headband ratchet mechanism.
Figure 50:
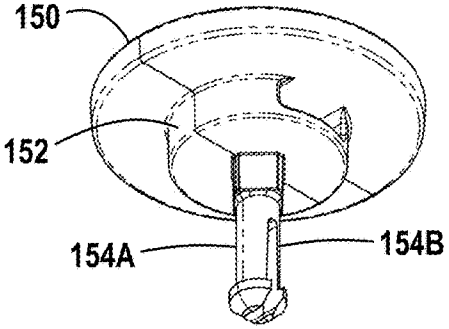
Figure 53:
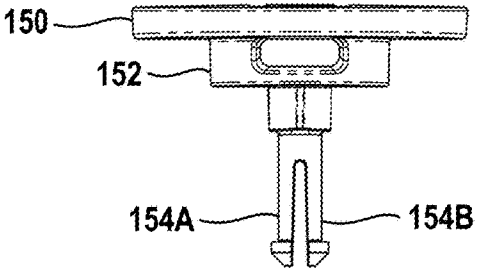
FIGS. 51, 52, 53, and 54 are top, front, side, and bottom views respectively of the release actuator.
Figure 51:
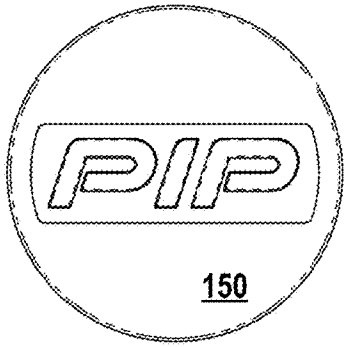
Figure 52:
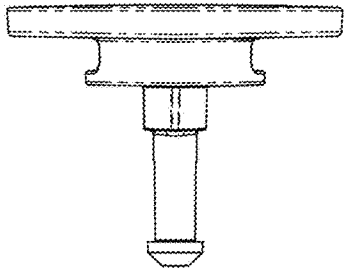
Figure 54:
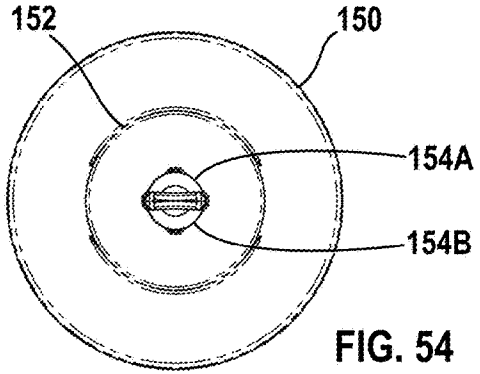
Figure 57:
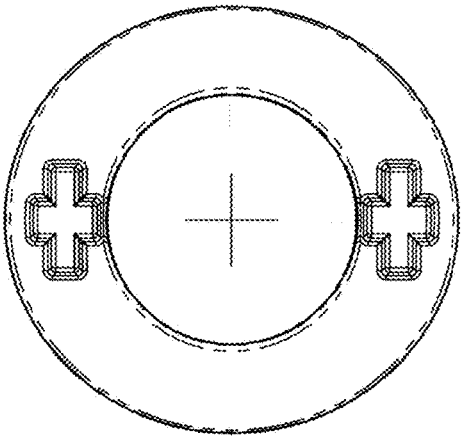
FIGS. 57, 58, and 59 are top, front, and bottom views respectively of the spring.
Figure 55:
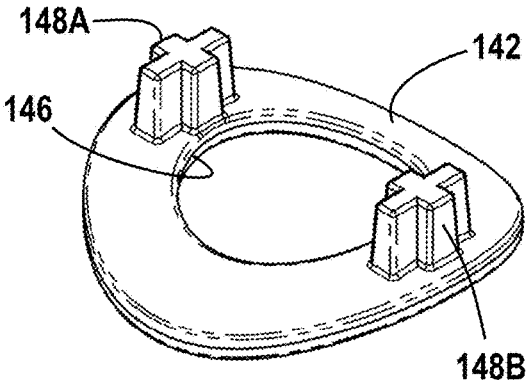
FIGS. 55 and 56 are top-front and bottom-front perspective views respectively of the spring of the quick-release headband ratchet mechanism.
Figure 58:
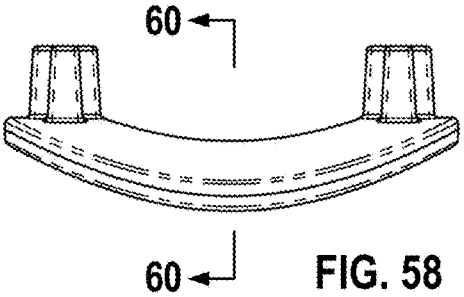
Figure 56:
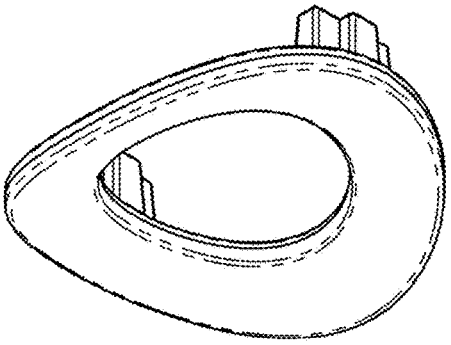
Figure 59:
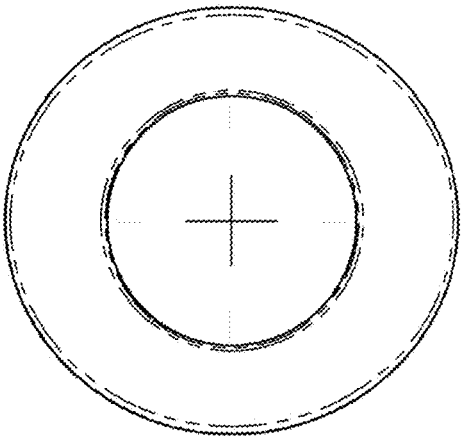
Figure 60:
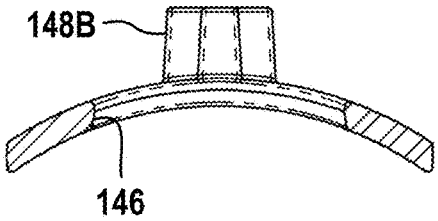
FIG. 60 is a sectional view of the spring taken along line 60-60 of FIG. 58.

The headband quick-release ratchet mechanism 10 includes a headband enclosure 12. The headband enclosure is formed by an arcuate base 14 attached to an overlying arcuate cover 16. The base is shown separately in FIGS. 12-17. The cover is shown separately in FIGS. 18-24. The base and the cover are removably attached to one another by cooperating latch arms 18 and latch openings 20 formed with the base and cover (see FIGS. 12 and 19). Other types of fasteners (such as screws or hook-and-loop fasteners) can also be used.

Cooperating facing plugs 22 and receiving sockets 24 (see FIGS. 12 and 19) of the base 12 and the cover 14 space apart portions of the base, forming sides of an open channel 26 extending through the headband enclosure 12. The channel has opposite open channel ends 28, 30 that receive respective opposite end portions of a headband that are aligned and guided through the channel by the sides of the channel. The headband enclosure 12 is shaped to generally conform with the back of the head for comfort while a user is wearing the headband.

The headband quick-release ratchet mechanism 10 has a pinion gear drive 32 that drives a pinion gear 34 disposed in the headband enclosure 12. The pinion gear drive includes a pinion member 36 that includes the pinion gear as an integral member, a ratchet gear 56, a face gear 58, and a knob 60 described in more detail below. The knob 60 is exposed to a user and, as viewed in FIG. 1, the user rotates the knob in a tightening direction T to drive the pinion gear 34 in a tightening direction that shortens the headband and rotates the knob in a loosening direction L to drive the pinion gear 34 in a loosening direction that lengthens the headband.

The pinion member 36 is shown in FIGS. 25-29. The pinion member has a tubular sleeve 38 that carries the pinion gear 34 on an end of the sleeve. The gear teeth of the pinion gear extend radially away from the sleeve. The pinion member also includes a pair of opposed elongate radial lugs 40A, 40B that extend longitudinally along the sleeve from the pinion gear to the opposite end of the sleeve, and extend radially outwardly from opposite sides of the sleeve. Each lug extends an angular extent about 30 degrees around the sleeve. The lugs define a pair of radial gaps 42A, 42B between the lugs extending around the outside of the sleeve.

The pinion gear drive 32 further includes a pinion gear mounting boss 44 forming part of the base 14 (see FIGS. 12 and 14-17). The pinion gear mounting boss is received in the pinion member sleeve 38 and rotatably locates the pinion 34 in the headband enclosure 12.

Figure 1:
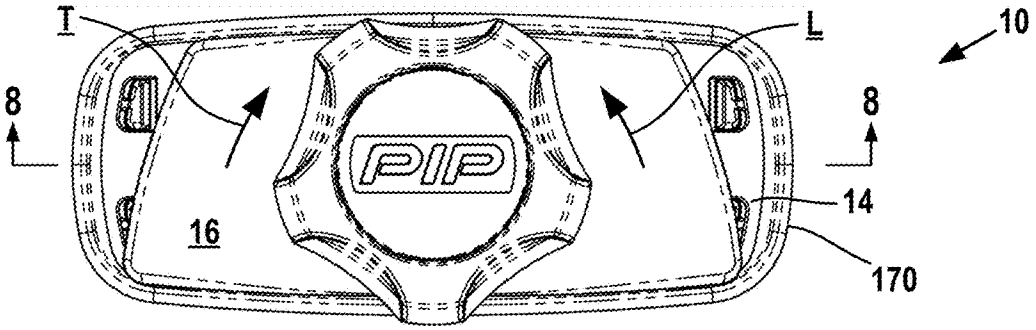
FIG. 1 is a top view of a quick-release headband ratchet mechanism in accordance with this disclosure with an attached pad.
Figure 3:
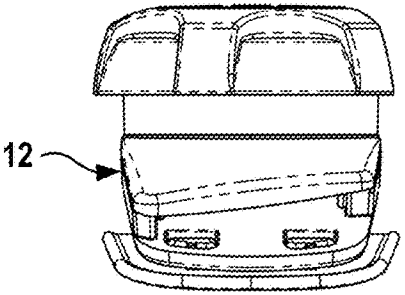
FIGS. 2, 3, 4, and 5 are front, side, bottom, and perspective views respectively of the quick-release headband ratchet mechanism shown in FIG. 1.
Figure 2:
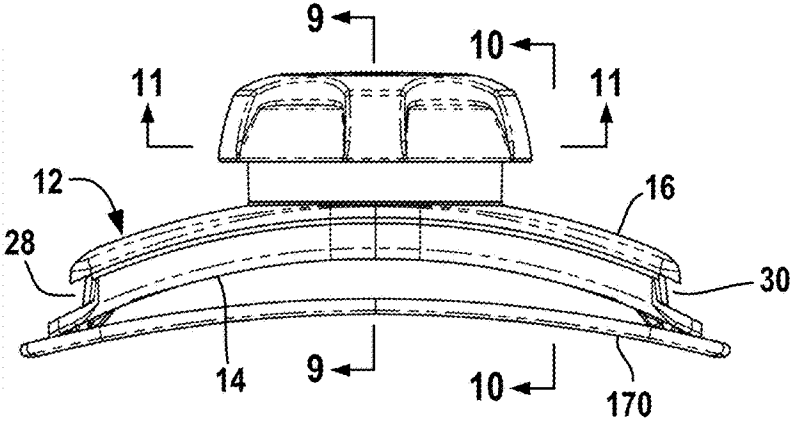
Figure 4:
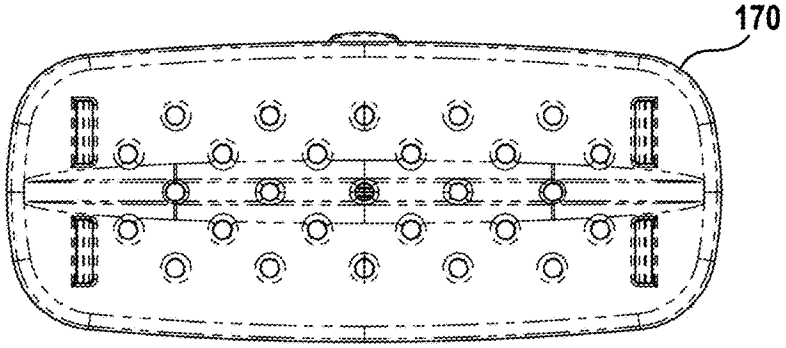
Figure 7:
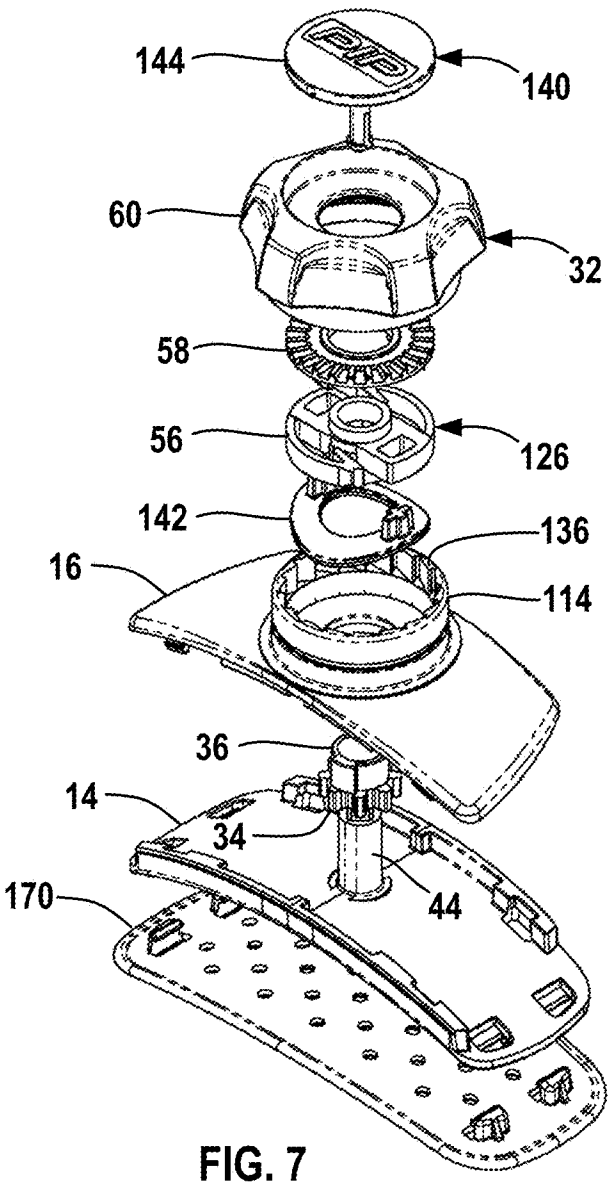
FIG. 7 is a top-front exploded view of the quick-release headband ratchet mechanism shown in FIG. 1.
Figure 6:
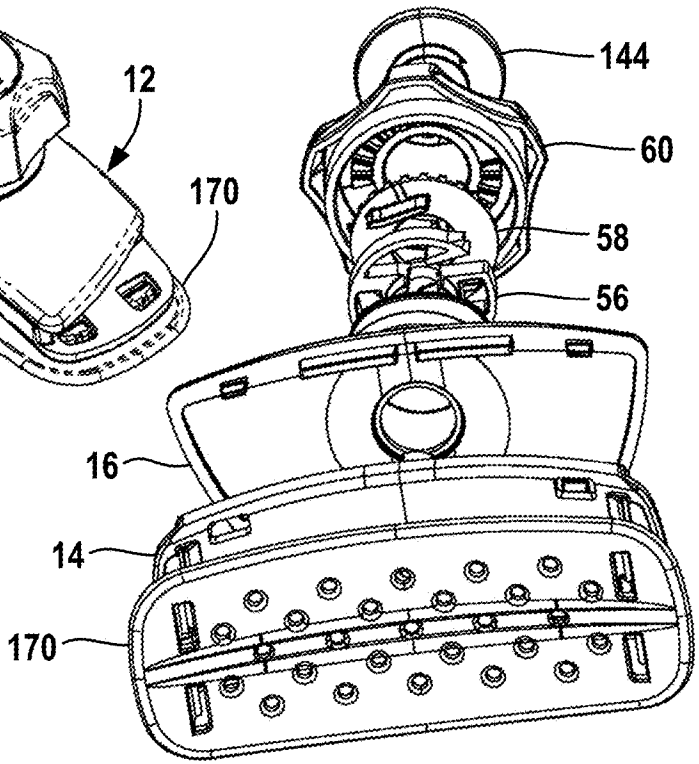
FIG. 6 is a bottom-front exploded view of the quick-release headband ratchet mechanism shown in FIG. 1.
Figure 5:
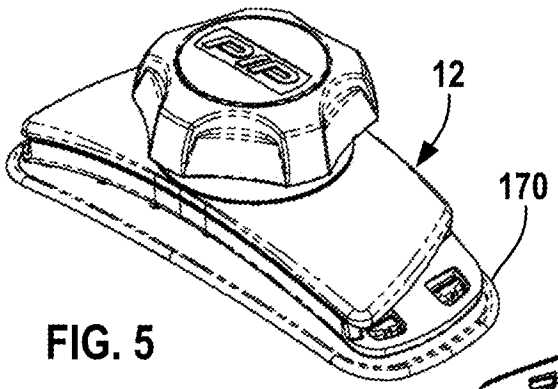
Figure 8:
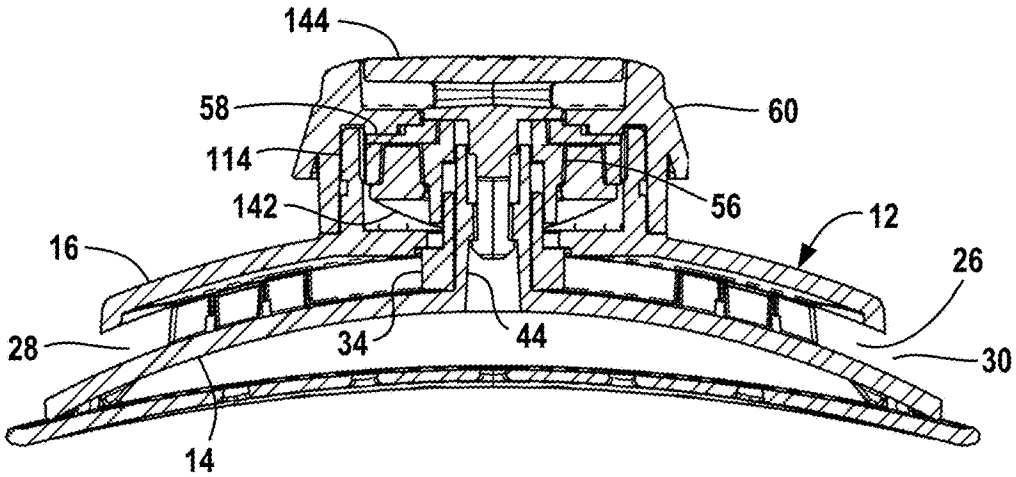
FIG. 8 is a sectional view of the quick-release headband ratchet mechanism taken along line 8-8 of FIG. 1.
Figure 10:
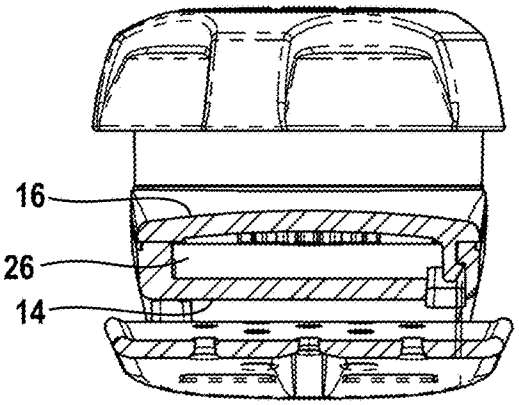
FIG. 10 is a sectional view of the quick-release headband ratchet mechanism taken along line 10-10 of FIG. 2.
Figure 9:
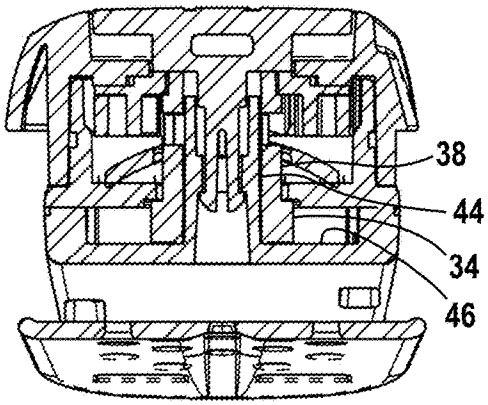
FIG. 9 is a sectional view of the quick-release headband ratchet mechanism taken along line 9-9 of FIG. 2.

The pinion gear mounting boss 44 extends away from an upper side 46 of the base 14 along a longitudinal axis 48 that defines an axis of rotation of the pinion gear 34 mounted on the pinion gear mounting boss and the other components that rotate with the pinion gear. The pinion gear mounting boss is centered between the channel ends 28, 30 as shown in FIG. 8. The pinion gear mounting boss extends through a through-hole 50 formed in the cover 16 and extends to an upper end 52 spaced away from the cover.

The pinion gear mounting boss 44 is received in and extends through the pinion member sleeve 38. The pinion gear 34 is against the base upper side 46. The pinion gear extends from the base side 46 into a counterbore 54 (see FIG. 24) of the cover through hole 50. The counterbore enables the pinion to extend the full height of the channel 26 to engage the headband end portions without interference to rotation. As viewed in FIG. 1 from above, the pinion member 36 rotates in a counterclockwise tightening direction causing the pinion gear to shorten and tighten the headband and rotates in a clockwise loosening direction causing the pinion gear to lengthen and loosen the headband.

The pinion member 36 is normally non-rotatably connected to the knob 60 disposed on the upper side of the ratchet mechanism 10 via the drive ratchet gear 56 and the face gear 58. Features of the ratchet gear, face gear, and the knob are discussed next.

The ratchet gear 56 is shown in FIGS. 30-34. The ratchet gear has a generally prismatic body 62 with parallel flat top and bottom surfaces 64, 66 spaced apart by the thickness of the body. A centered circular through-opening 68 extends through the thickness of the body. The through opening 68 is sized to receive the pinion gear mounting boss 44 for rotation of the ratchet gear about the pinion gear mounting boss axis 48. A tubular boss 70 on the top surface 64 extends away from and surrounds the through-opening 68. The boss 70 locates the face gear 58 onto the ratchet gear. A pair of opposed arcuate legs 72A, 72B extend away from the bottom surface 64. The opposed legs are disposed and configured to be received in the gaps 42A, 42B of the pinion member 36 and cooperate with the lugs to non-rotatably connect the ratchet gear and the pinion member.

The ratchet gear 56 further includes a pair of generally rectangular through-holes 74A, 74B located on radially opposite sides of the through bore 68. The walls of the through-holes 74A, 74B non-rotatably connect the ratchet gear and a spring (discussed below). A pair of arcuate, like elongate pawl arms 76A, 76B extend from opposite ends of the ratchet gear adjacent opposite sides of the body. The pawl arms and springs form part of the ratchet mechanism that will be described in more further below.

The face gear 58 is shown in FIGS. 35-40. The face gear operates as a torque transmission member between the knob 60 and the ratchet gear 56. The face gear has an annular-shaped planar body 78 formed as a circular disc. The disc 78 carries a set of serrated teeth 80 on a top surface 82 of the disc. The teeth are spaced along the outer perimeter of the top surface and extend radially away from the outer perimeter and away from the top surface in a vertical height direction perpendicular to the radial direction. A central circular through-opening 84 extends through the thickness of the disc from the top surface to the bottom surface 86. A tubular boss 88 surrounds the through-bore and is aligned with the outer periphery of the through-bore. The boss 88 extends from the disc top surface a height slightly greater than the maximum height of the teeth.

The tubular boss 70 of the ratchet gear 56 is closely received into the face gear through-opening 84 and the tubular boss 88 to locate the face gear 58 atop the ratchet gear. The upper end of the ratchet gear boss 70 is essentially flush with the upper end of the face gear boss. The face gear further includes a pair of spaced-apart legs 90A, 90B extending from the bottom surface 86. The legs 90A, 90B closely receive between them the body 62 of the ratchet gear and non-rotatably connect the face gear and the ratchet gear.

The knob 60 is shown in FIGS. 41-48. The knob 60 has a tubular body 92 that extends from a knob upper end 94 to a knob lower end 96. The tubular body 92 extends along a central longitudinal axis 98. The portion of the tubular body 92 adjacent the upper end surrounds a reduced-diameter upper bore 100 open to the knob upper end. The portion of the tubular body adjacent the lower end surrounds an enlarged-diameter lower bore 102. The lower bore is coaxial with the upper bore and is open to the knob lower end. An internal dividing wall 104 divides the upper bore from the lower bore.

The dividing wall 104 has opposite upper and lower flat surfaces 106, 108 facing the upper bore 100 and the lower bore 102 respectively. The lower surface 108 carries a set of serrated teeth 110 (in some of the figures only a portion of the teeth 110 are shown). The knob teeth are sized and configured to overlay and mesh with the face gear teeth 80 to form a non-rotatable connection between the knob 60 and the face gear 58 (similar in principle to operation to the facing locking teeth of a Hirth joint) when the knob is being turned to drive the pinion gear 34.

The knob tubular body 92 includes a radially enlarged handle 112 attached to the upper end of the body 92. The handle defines a hand grip that is spaced from and surrounds the knob body 92. The grip's contours enable a user to comfortably grip and rotate the knob when tightening the headband.

The knob 60 is mounted onto a knob mounting boss 114 attached to the upper surface 116 of the cover 16 (see FIG. 8). The knob mounting boss is formed as a circular tubular member that extends from the cover to an upper end 118 spaced away from the cover (see FIGS. 18-22 and 24). The knob mounting boss surrounds and is coaxial with the pinion gear mounting boss 44 about the axis of rotation 48 and extends along the axis of rotation beyond the upper end of the pinion gear mounting boss. The knob mounting boss also receives within it a portion of the pinion member sleeve 38, as well as the ratchet gear 56 and the face gear 58.

The knob body 92 is rotatably mounted on top of the knob mounting boss 114. The knob mounting boss is closely received through the knob body into the knob lower bore 102. A recessed annular groove 120 (see Figs) formed in the lower surface of the knob wall 104 receives the upper end of the knob mounting boss and establishes the spacing of the knob away from the cover. The knob includes a circumferential bulge 122 that extends into the knob lower bore. The bulge is received into a recessed circumferential groove 124 formed on the outside of the knob mounting boss. The bulge 122 and the groove 124 cooperate to resist longitudinal movement of the knob away from the cover while allowing rotation of the knob about the knob mounting boss.

The headband adjustment quick-release mechanism 10 includes a ratchet mechanism 126 that cooperates with the pinion gear drive 32. The ratchet mechanism enables a user to rotate the knob 60 in either the tightening direction or the loosening direction to shorten or lengthen the headband. The ratchet mechanism, however, resists rotation of the knob in the loosening direction caused by headband tension when the knob is not being rotated or prevented from rotation by the user. This feature maintains tightness of the headband during normal use of the safety helmet.

As mentioned above, the ratchet mechanism 126 includes the like pawl arms 76A, 76B of the ratchet gear 56. The pawl arms can be thought conceptually as carrying gear teeth at the free ends of the pawl arms that interact and cooperate with ratchet teeth carried by the ring gear as described in more detail below. The pawl arms extend away from opposite sides of the ratchet gear body 62 radially away from and circumferentially in the loosening direction of rotation to respective free ends 128A, 128B as best seen in FIG. 32. Each pawl arm is an elongate, elastically resilient arcuate member extending along and cooperating with the ratchet gear body to fit generally within a circular outer boundary 130 bounding the ratchet gear. Each pawl arm free end 128A, 128B includes a similar V-notch 132 that interact and cooperate with the ratchet teeth. A leg 134 of the V-notch extends radially beyond the bounding boundary and is generally perpendicular to the bounding boundary. The V-notch includes an elongate notch arm 135 that extends towards the ratchet gear body 62 as it extends away from the V-notch.

The ratchet mechanism 126 further includes a ring gear 135 formed as an upper end portion of the knob mounting boss 114. The ring gear has a number of ratchet teeth 136 that are adjacent to the open upper end of the knob mounting boss 114. See FIGS. 11, 20, and 24. The ratchet teeth extend around the inner wall 138 of the knob mounting boss 114 and extend radially into the interior of the knob mounting boss. The ratchet teeth are each steeper on one side of the tooth 136A (that is, the one side of the tooth extends perpendicular to or near perpendicular to the circumferential direction about the annular wall 126) and are much less steep on the opposite side 136B of the tooth (that is, the opposite side of the tooth is inclined away from the perpendicular and is substantially parallel with or near parallel with the circumferential direction about the annular wall 138).

The ratchet gear 56 is normally located along the pinion gear mounting boss 44 with its pawl arms 76A, 76B aligned with and facing the ratchet teeth 136. The ratchet gear circular bounding boundary 130 is closely received within the ratchet teeth 136, wherein the resiliency of the pawl arms urge the pawl legs 134 against the ratchet teeth.

Figure 11:
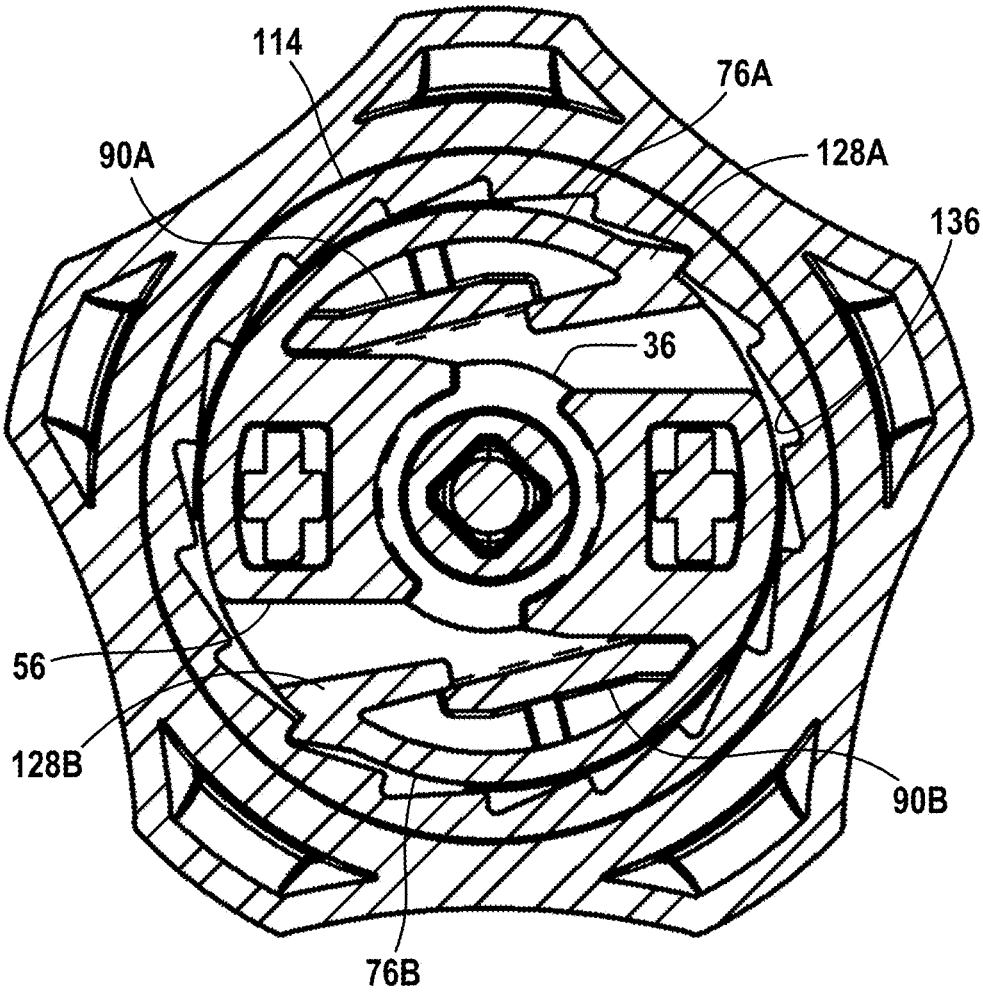
FIG. 11 is a sectional view of the quick-release headband ratchet mechanism taken along line 11-11 of FIG. 2 while tightening a headband.
Figure 11A:
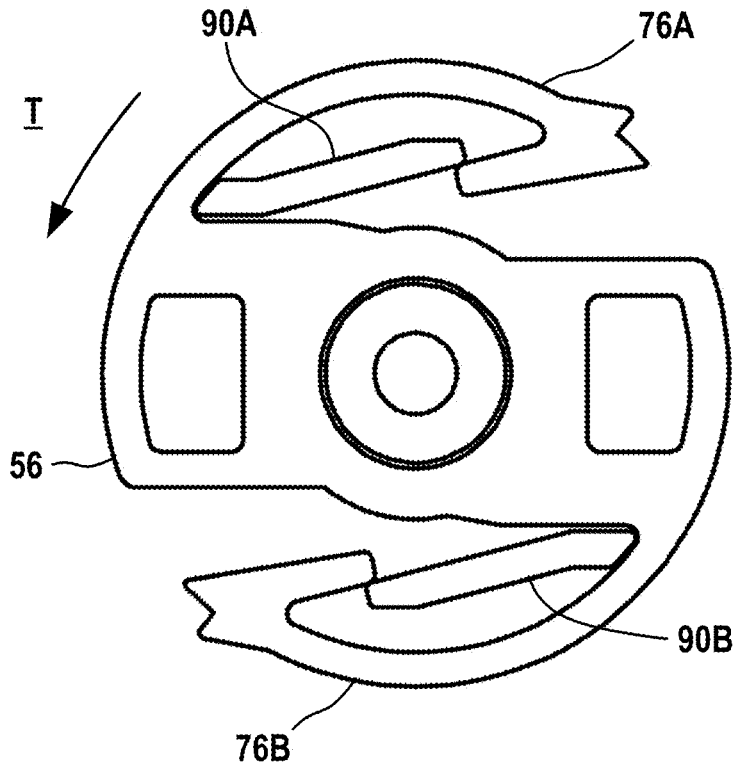
FIG. 11A is a simplified view taken along line 11-11 of FIG. 2 illustrating the relationship of the face gear legs and the ratchet gear while rotating in the tightening direction.

Rotation of the face gear 58 in the tightening direction of the pinion gear 34 forces the face gear legs 90A, 90B against the ratchet gear body 62 adjacent to where the pawl arms 76A, 76B extend from the body. FIGS. 11 and 11A illustrate the gear legs 90A, 90B forced against the ratchet gear body (note the views of FIGS. 11 and 11A are both taken along line 11-11 of FIG. 1 and are in the opposite direction of view of the FIG. 1 top view). The pair of face gear legs 90A, 90B (alternatively referred to here in as drive members 90A, 90B) transmit torque to the ratchet gear causing conjoint rotation of the ratchet gear in the tightening direction T. The face gear legs 90A, 90B do not resist deflection of the free ends 128 of the pawl arms radially away from the ratchet teeth 137. The pawl arms elastically flex as they slide over the ratchet teeth and allow rotation of the ratchet gear in the tightening direction.

The pawl arms 76A, 76B can be configured to provide some resistive feedback to the user indexing rotation of the knob 60 as the pawl arms flex in moving tooth to tooth during rotation of the knob. The Binduga '245 patent describes in its column 5 a formula for calculating the resisting capacity of a serrated ratchet mechanism as a function of tooth angle in degrees.

Rotation of the face gear 58 in the loosening direction of the pinion gear 34 forces the face gear legs 90A, 90B (drive members 90A, 90B) against the notch arms 135 of the ratchet gear. See FIG. 11B. The face gear legs transmit forces to the notch arms that urge the free ends of the pawl arms 76A, 76B radially inwardly away from the ratchet teeth 137 and against the gear face body 62. The face gear legs transmit torque to the ratchet gear causing conjoint rotation of the ratchet gear in the loosening direction L. The pawl arms do not contact the ratchet teeth 137.

Figure 11B:
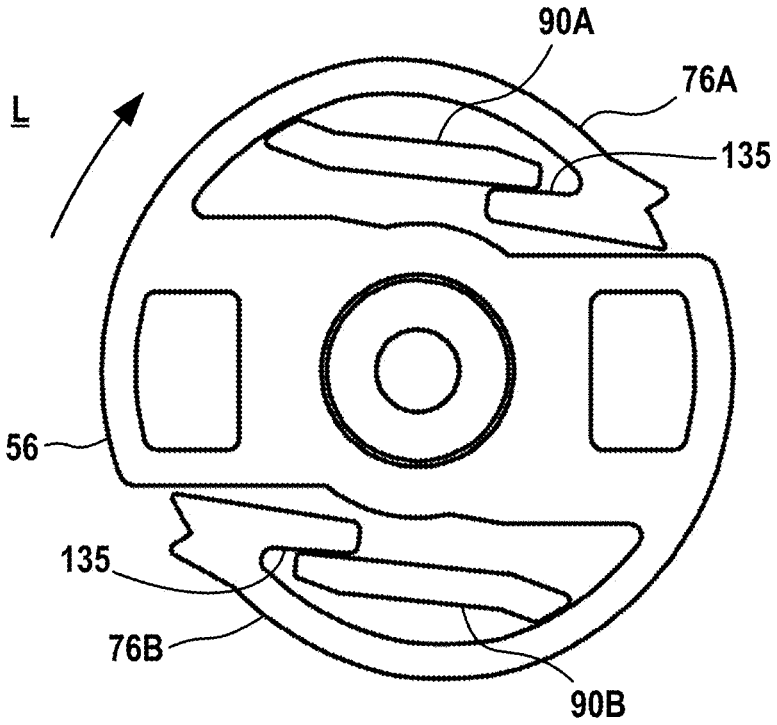
FIG. 11B is a simplified view taken along line 11-11 of FIG. 2 illustrating the relationship of the face gear legs and the ratchet gear while rotating in the loosening direction.
Figure 18:
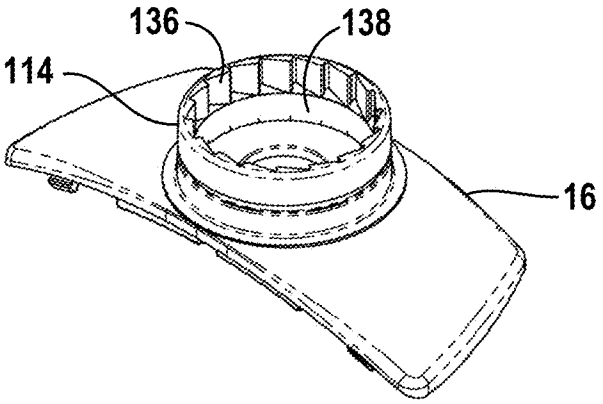
FIGS. 18 and 19 are top-side and bottom-side perspective views respectively of the cover of the quick-release headband ratchet mechanism.

The knob 60 has lost motion that does not transmit torque to the pinion gear 34 when rotating between the operating positions of the ratchet mechanism shown in FIGS. 11A and 11B. The "lost motion" of the knob enables the knob to rotate without corresponding rotation of the pinion gear. The lost motion is inherent in the non-rotatable connection between the face gear legs 90A, 90B and associated pawl arms 76A, 76B and is demonstrated by the change in relative angular position of the face gear legs with respect to the ratchet gear 56 carrying the pawl arms (indicating the face gear legs have rotated without driving the pinion gear). The lost motion is limited and does not affect the utility or usability of the headband adjustment quick-release mechanism 10.

When the knob 60 is not being rotated or is not being held against rotation, the pawl arms 76A, 76B are free to elastically deflect towards their normal location with the pawl arms aligned with and facing the ratchet teeth 136. Urged rotation of the ratchet gear 56 in the loosening direction of the pinion gear 34 caused by headband tension forces the pawl legs 134 against respective steep first sides 136A of the ratchet teeth 136 as seen in FIG. 11 with respect to the pawl arm/ratchet tooth arrangement. The teeth are received into the pawl arm V-notches 132, forming a non-rotatable connection between the ratchet teeth and the ratchet gear 56 that resists and prevents rotation of the pinion gear 34 in the loosening direction while ratchet gear teeth are received in the pawl arm notches.

The headband adjustment quick-release mechanism 10 further includes a release mechanism 140. The release mechanism is selectively actuated by the user and operatively disconnects the ratchet mechanism 126 from the pinion gear 34, thereby enabling the pinion gear to "free-wheel" and rotate essentially freely in the loosening direction in response to headband tension. The illustrated release mechanism also operatively disconnects the knob 60 from the pinion whereby the pinion gear can free-wheel without the knob rotating.

The release mechanism 140 includes a compression spring 142 and a release actuator 144. The compression spring is shown in FIGS. 55-60. The illustrated compression spring is a curved disc spring. Other types of compression springs (for example, helical compression springs, Belleville springs, and the like) can be used in other embodiments of the quick-release ratchet mechanism in accordance with this disclosure.

The compression spring 142 includes a central through-opening 146 sized to closely receive and not interfere with rotation of the pinion member 36. The compression spring has a pair of legs 148A, 148B that extend into the ratchet gear rectangular holes 70A, 70B, thereby non-rotatably connecting the compression spring and the ratchet gear 56.

The compression spring 142 is contained in the longitudinal direction 48 between the cover 16 and the ratchet gear 56 (see FIG. 8). The compression spring applies a force against the ratchet gear 56 urging the ratchet gear away from the pinion gear 34 and in turn normally urging the face gear teeth 80 into meshing engagement with the set of knob teeth 110. The teeth engagement non-rotatably connects the knob 60 of the pinion gear drive 32 with the pinion. The face gear disk 78 is normal to the axis of rotation and is closely received in the upper end of the ring gear 135. The ratchet gear pawl arms 76A, 76B are aligned with and face the ratchet gear teeth 110 as shown in FIG. 11 whereby the ratchet mechanism 126 is operable to enable rotation of the pinion gear in the tightening and loosening directions.

The release actuator 144 is shown in FIGS. 49-54. The release actuator serves as a manually operated actuator that actuates the release mechanism 140. The release actuator includes a circular outer or upper push plate 150 connected to and concentric with a circular, reduced diameter inner or lower push plate 152. Extending from the lower push plate are a pair of elongate latch arms 154A, 154B. The latch arms extend into an open central bore 156 of the pinion gear mounting boss 44 (see FIG. 17 and FIG. 61). The wall 162 surrounding the central bore 156 has a generally rectangular cross section to form a non-rotatable connection between the release actuator and the pinion gear mounting boss. The latch arms extend through a reduced opening portion 164 of the annular wall 162 formed in the pinion gear mounting boss bore. The reduced opening defines an abutment surface 166 that prevents the latch arms from moving past the surface in moving towards the knob 60.

FIG. 8 illustrates the headband adjustment quick-release ratchet mechanism 10 in the normal engaged operating state wherein the release mechanism 140 has not disconnected the ratchet mechanism 126 from the pinion gear 34. The compression spring 142 is applying a force transmitted through the body gear 56 to the face gear 58 urging the body gear and the face gear to translate along the pinion gear mounting boss longitudinal axis 48. The face gear teeth 80 are pressed into meshed engagement with the knob sets of gear teeth 110. The body gear is adjacent to and faces the ratchet teeth 136. The body gear and the face washer cooperate to push the release actuator 144 away from the cover, locating the release actuator upper push plate essentially flush with the top of the knob. The pinion gear is operatively engaged with the knob 60 and the knob can drive the pinion gear as previously described.

Figure 61:
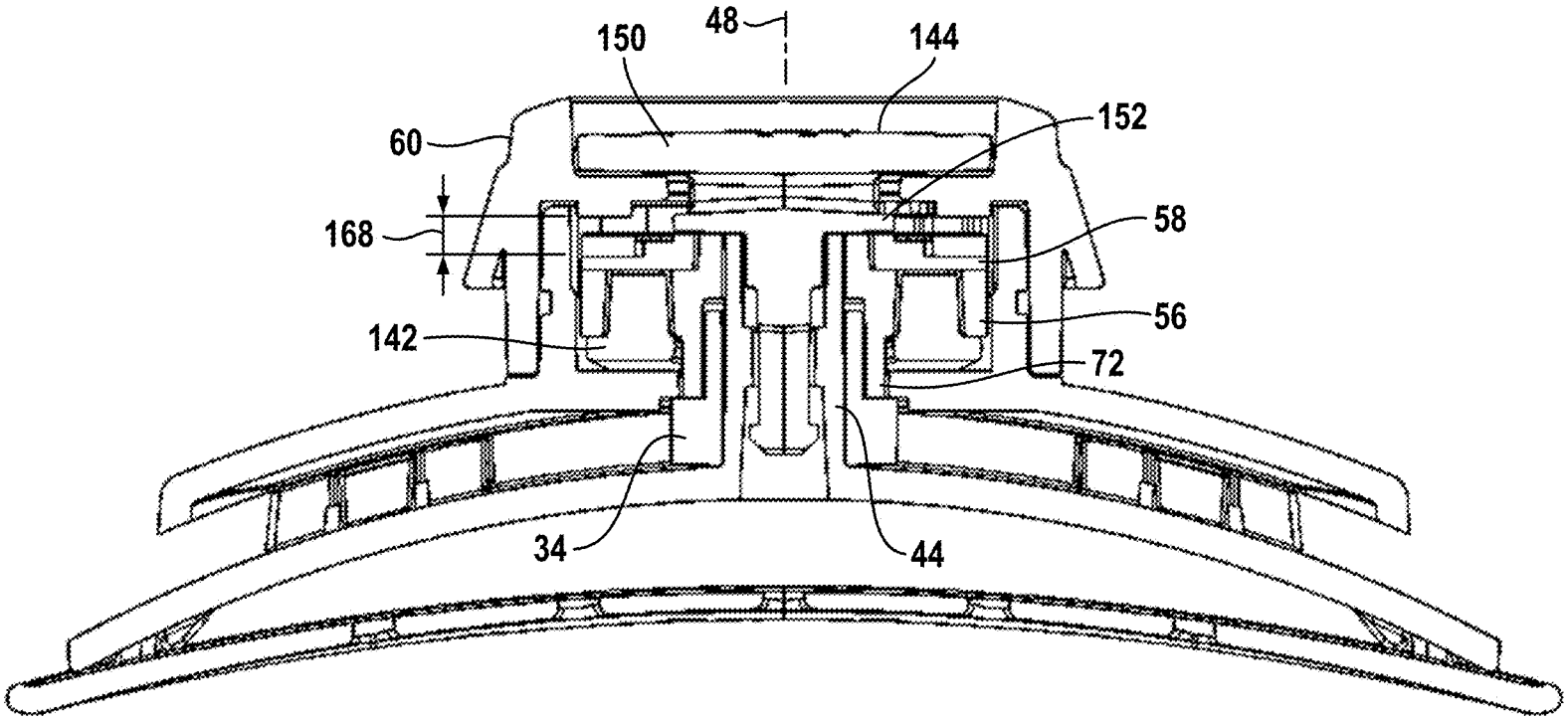
FIG. 61 is a sectional view similar to FIG. 8 but with the quick-release headband ratchet mechanism in a free-wheel operating state.
Figure 62:
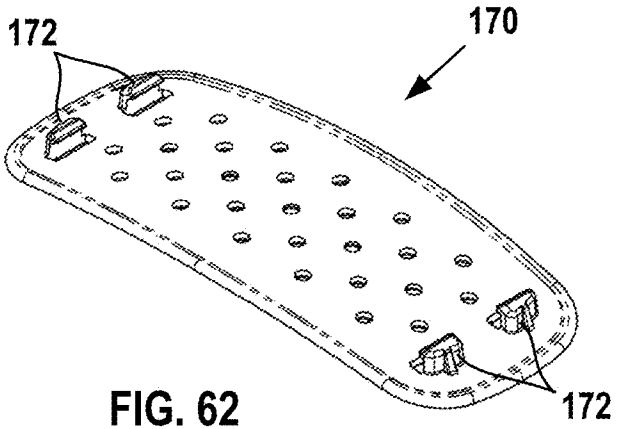
FIGS. 62 and 63 are top-side and bottom-side perspective views respectively of the pad attached to the quick-release headband ratchet mechanism.
Figure 63:
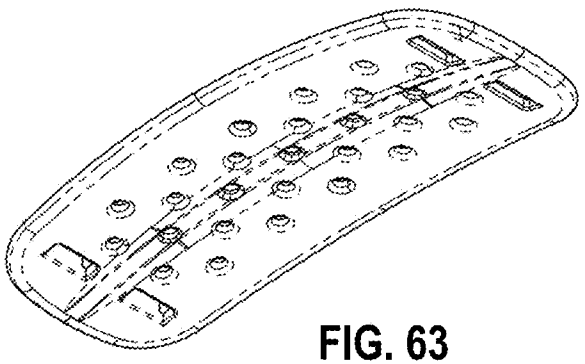
Figure 64:
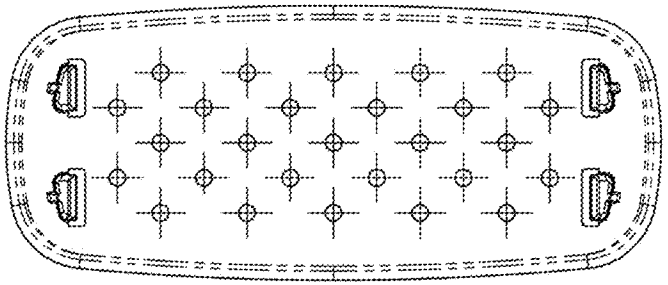
FIGS. 64 and 65 are top and bottom views respectively of the pad.
Figure 65:
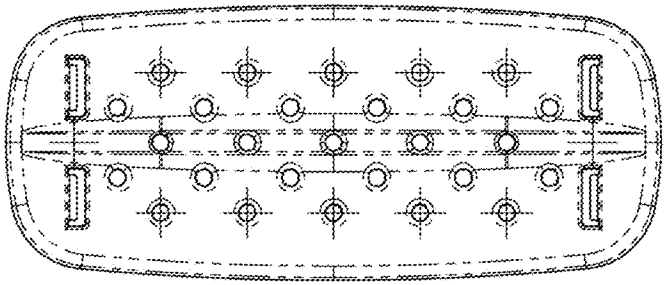
Figure 66:
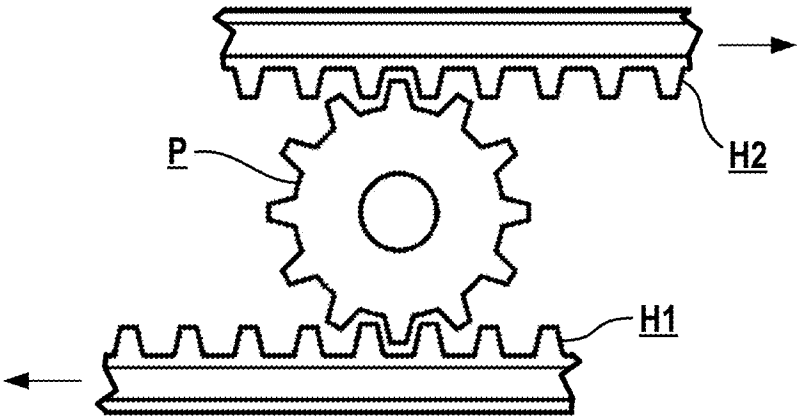
FIG. 66 PRIOR ART
FIG. 66 illustrates a pinion gear of a headband adjustment mechanism engaged with rack teeth formed in the end portions of a headband of a safety helmet that causes rotation of the pinion gear to tighten/loosen the headband.

FIG. 61 illustrates the headband adjustment quick-release ratchet mechanism 10 in a free-wheel operating state. The user is applying a force to the release actuator upper push plate 150 pushing the push plate further into the knob upper bore 100. The user-applied force overcomes the compression spring 142 whereby the release actuator lower push plate 152 pushes the face gear 58 and the ratchet gear 56 an axial distance 168 downwardly along the pinion gear mounting boss 44 and its longitudinal axis 48 away from the knob 60 and towards the pinion gear 34, compressing the spring. The spring compression enables sufficient translation 168 of the face gear and the ratchet gear for the ratchet gear legs 72 to abut against the top of the pinion gear, defining the end of downward travel of the release actuator, face gear, and ratchet gear towards the pinion gear. The displacement causes the face gear 58 to be sufficiently spaced away from the knob 60 to fully disengage the face gear teeth from the knob teeth. The displacement also causes the ratchet gear pawl arms 76A, 76B to move out of engagement with the ratchet teeth. The ratchet gear and the pawl arms are now surrounded by and spaced inwardly from the portion of the knob mounting boss wall 138 not having any ratchet teeth extending inwardly therefrom, thereby operatively disconnecting the ratchet mechanism 126 from the pinion gear drive 32. The pinion gear is also operatively disconnected from the knob and is able to free-wheel and rotate in response to headband tension or to the user manually lengthening the headband without rotation of the knob.

Removing the user-applied force to the release actuator 144 causes the compression spring 142 to decompress and push the ratchet gear 56, the face washer 58, and the release actuator 144 away from the cover 12 and thereby automatically returning the quick-release ratchet mechanism 10 to its engaged state.

For increased user comfort, an elastic comfort pad 170 can be removably attached to the base 14 as shown in FIGS. 1-11. The pad by itself is shown in FIGS. 62-65. The pad includes latch arms 172 that are received in cooperating base latch openings 174 (see FIG. 14). The comfort pad readily conforms to the shape of a user's head. The illustrated comfort pad also has ventilation openings extending through the pad for increased user comfort.

The disclosed quick-release ratchet mechanism can be used with helmet suspension systems of safety helmets that protect the face (such as a welder's mask) or safety helmets that are placed over the head to protect the head (such as a construction hard hat or fireman's hat). Use with helmets placed over the head may place the knob outside of the helmet (typically in the back of the helmet) to expose the knob and release actuator, with the remainder of the disclosed quick-release ratchet mechanism inside the helmet.

In other embodiments of the disclosed quick-release ratchet mechanism, the release actuator has a convex or concave surface to be pressed by a user. The release actuator may be normally recessed within the knob or may protrude from the knob.

In yet other embodiments of the disclosed ratchet mechanism, the release actuator is eliminated and the ratchet member is always in the engaged state. The ratchet gear and the face gear may be formed as a single, one-piece member. The ratchet gear, face gear, and all or portions of the pinion member may be formed as a single, one-piece member.

The components of the disclosed quick-release ratchet mechanism 10 may be made from suitable plastics or metals. Materials suitable for high-temperature environments can be used if needed (for use with firefighter helmets for example).

While this disclosure includes one or more illustrative embodiments described in detail, it is understood that the one or more embodiments are each capable of modification and that the scope of this disclosure is not limited to the precise details set forth herein but include such modifications that would be obvious to a person of ordinary skill in the relevant art including (but not limited to) changes in material selection, environment of use, headband suspension attachment, and the like, as well as such changes and alterations that fall within the purview of the following claims.

What is claimed is:

1. A quick-release headband mechanism for tightening/loosening a headband of a safety helmet, comprising:

a housing having open opposite first and second ends and configured to receive opposite end portions of the headband into an interior of the housing;

a pinion gear having a plurality of gear teeth being disposed in the interior of the housing, the pinion gear being rotatable about an axis of rotation in a tightening direction and an opposite loosening direction;

a knob and a torque transmission member each being disposed on the axis of rotation and rotatable about the axis of rotation, the torque transmission member being disposed on the axis of rotation between the knob and the pinion gear, the knob being exposed to enable a user to rotate the knob to tighten or loosen the headband;

the knob comprising a through hole extending parallel with the axis of rotation through the knob and a plurality of teeth being disposed around the axis of rotation and facing the torque transmission member;

the torque transmission member being non-rotatably connected to the pinion gear for conjoint rotation with the pinion gear, the torque transmission member comprising a plurality of teeth being disposed around the axis of rotation and facing the knob, the torque transmission member being relatively axially movable with respect to the knob along the axis of rotation towards and away from the knob between a first position wherein the torque transmission member teeth are meshed with the knob teeth and non-rotatably connect the torque transmission member with the knob, and a second position wherein the torque transmission member teeth are spaced apart from and are not meshed with the knob teeth wherein the torque transmission member is operatively disconnected from the knob;

a spring being disposed to generate a spring force applied to the torque transmission member urging the torque transmission member to the second position, the spring being elastically deformable in response to the torque transmission member moving between first and second positions to generate spring force at both of the first and second positions of the torque transmission member; and an actuator being at least partially disposed in the knob bore and being axially movable with respect to the knob, the actuator capable of being pushed by a user to displace the torque transmission member from the first position to the second position whereby the torque transmission member and the pinion gear are rotatably released from the knob and can rotate independently of the knob.

2. The quick-release headband mechanism of claim 1 wherein the spring is a curved disc spring being disposed against the housing and between the housing and the torque transmission member.

3. The quick-release headband mechanism of claim 2 wherein the disc spring is non-rotatably connected to the torque transmission member and is conjointly rotatable with the torque transmission member.

4. The quick-release headband mechanism of claim 1 comprising a pinion gear mounting boss extending along the axis of rotation surface of the housing and out of the housing to an upper end of the pinion gear mounting boss; and the pinion gear, spring, and the torque transmission member each comprising a respective through hole having an interior wall that closely receives the pinion gear mounting boss, the spring and the torque transmission member being disposed outside of the housing with the spring being disposed against the housing.

5. The quick-release headband mechanism of claim 3 wherein the pinion gear mounting boss is a tubular member having an annular inner wall surrounding the interior of the tubular member, the inner wall defining a reduced diameter portion of the pinion gear mounting boss; and the actuator comprises a latch arm extending through the reduced diameter portion of the pinion gear mounting boss, the latch arm engaging against the reduced diameter portion of the inner wall and thereby limiting axial movement of the actuator away from the pinion gear mounting boss.

6. The quick-release headband mechanism of claim 1 comprising a tubular knob mounting boss extending from the housing along the axis of rotation to an upper end of the knob mounting boss, the knob being rotatably mounted on the knob mounting boss, the spring and the torque transmission member being disposed inside the knob mounting boss.

7. The quick-release headband mechanism of claim 1 wherein the torque transmission member comprises a flat surface facing the knob, the teeth of the torque transmission member extending axially from the said flat surface.

8. The quick-release headband mechanism of claim 7 wherein the actuator engages against a tubular boss of the torque transmission member when urging the torque transmission member from the first position to the second position, the tubular boss being coaxial with the axis of rotation, the teeth of the torque transmission member surrounding the tubular boss.

9. The quick release member of claim 1 wherein the actuator comprises a flat outer surface flush with an end of the knob bore when the torque transmission member is in the first position.

10. The quick-release headband mechanism of claim 1 wherein the spring force generated by the spring is transmitted to the actuator and urges the actuator axially away from the pinion gear, the actuator engaging a fixed stop surface that limits axial movement of the actuator away from the spring.

11. The quick-release headband mechanism of claim 10 wherein the actuator comprises a flat outer surface flush with an end of the knob bore when the actuator is engaged against the stop surface.

12. A headband ratchet mechanism for tightening/loosening a headband of a safety helmet, comprising:

a housing having open opposite first and second ends and configured to receive opposite end portions of the headband into an interior of the housing;

a pinion gear having a plurality of gear teeth being disposed in the interior of the housing, the pinion gear being rotatable about an axis of rotation in a tightening direction and an opposite loosening direction;

a pinion gear drive for driving the pinion gear in the tightening and opposite loosening directions, the pinion gear drive comprising ratchet gear, the knob being disposed on the axis of rotation and being rotatable about the axis of rotation in the tightening and loosening directions, the knob being accessible to a user to rotate the knob to tighten or loosen the headband, the ratchet gear being disposed on the axis of rotation between the knob and the pinion gear, the ratchet gear comprising a body being rotatable about the axis of rotation in the tightening and loosening directions and being normally non-rotatably connected to both the knob and the pinion gear;

a ratchet mechanism comprising a ring gear, at least one pawl arm extending radially from the body of the ratchet gear, and a torque transmission member b being disposed between the ratchet gear and the knob on the axis of rotation, the torque transmission member being normally non-rotatably connected to the knob and conjointly rotatable with the knob, the torque transmission member comprising at least one drive member, each individual drive member of the at least one drive member being associated with a respective individual pawl arm of the at least one pawl arm;

the ring gear normally surrounding the ratchet gear, the ring gear being coaxial with the ratchet gear with respect to the axis of rotation, the ring gear being fixed with respect to the axis of rotation and comprising a plurality of radially extending teeth wherein each tooth has a steep tooth angle on a first side thereof and a less-steep tooth angle on a second side thereof;

each individual pawl arm of the at least one pawl arm being a resilient member extending away from the ratchet gear body to a free end portion of the individual pawl arm, the resiliency of the individual pawl arm urging the free end portion of the individual pawl arm to face towards the steep side of a tooth of the ring gear while the ratchet gear is stationary with respect to the axis of rotation, the steep sides of the plurality of teeth of the ring gear being disposed to engage against the free end portion of the individual pawl arm and resist and prevent rotation of the ratchet gear in the loosening direction in response to a force applied to the pinion gear teeth urging rotation of the pinion gear in the loosening direction;

each individual drive member of the at least one drive member of the torque transmission member being disposed to extend parallel with the axis of rotation to the ratchet gear, the individual drive member being disposed between the ratchet gear body and the pawl arm associated with the individual drive member, the individual drive member being disposed to engage against a first portion of the associated pawl arm when the torque transmission member rotates in the tightening direction that urges the ratchet gear to rotate in the tightening direction whereby the associated pawl arm slides over the less-steep sides of the plurality of ring gear teeth during rotation of the ratchet gear in the tightening direction, and being disposed to engage against a second portion of the associated pawl arm when the knob is rotating in the loosening direction that urges the associated pawl arm away from engagement with the ring gear teeth whereby the associated pawl arm does not prevent rotation of the body in the loosening direction; and a release mechanism for selectively disconnecting the knob from the pinion gear comprising an actuator, a spring, and the torque transmission member comprising a plurality of teeth facing the knob, the knob comprising a plurality of teeth facing the torque transmission member, the torque transmission member being relatively axially movable with respect to the knob towards and away from the knob between a first position wherein the torque transmission member teeth are meshed with the knob teeth wherein the meshed teeth non-rotatably connect the torque transmission member with the knob and a second position wherein the torque transmission member teeth are spaced apart from and are not meshed with the knob teeth, the spring being disposed to generate a spring force applied to the torque transmission member urging the torque transmission member to the first position, the spring being elastically deformable in response to the torque transmission member moving between first and second positions to generate spring force at both of the first and second positions of the torque transmission member, the actuator being at least partially disposed in a knob bore and being axially movable with respect to the knob, the actuator capable of being pushed by a user to displace the torque transmission member from the first position to the second position whereby the torque transmission member and the pinion gear are both rotatably released from the knob and can rotate independently of the knob.

13. The headband ratchet mechanism of claim 12 wherein the ratchet gear is axially movable along the axis of rotation between spaced apart first and second operating positions, the ratchet gear when in the first operating position being surrounded by the ring gear teeth and when in the second operating position not being surrounded by the ring gear teeth; and the torque transmission member pushing the ratchet gear from the first operating position to the second operating position when the torque transmission member moves from the first position of the torque transmission member to the second position of the torque transmission member.

14. The headband ratchet mechanism of claim 13 wherein the spring generates a spring force applied to the ratchet gear urging the ratchet gear towards the first operating position that is transferred from the ratchet gear to the torque transmission member and thereby urging the torque transmission member towards the first position of the torque transmission member, the spring being elastically deformable in response to the ratchet gear moving between first and second operating positions to generate spring force at both of the first and second operating positions of the ratchet gear.

15. The headband ratchet mechanism of claim 14 wherein the pinion gear drive comprises a pinion gear mounting boss and a knob mounting boss; and the pinion gear mounting boss extending along the axis of rotation from an interior surface of the housing and out of the housing to an upper end of the pinion gear mounting boss; and the pinion gear, spring, ratchet gear, and the torque transmission member each comprising a respective through hole having an interior wall that closely receives the pinion gear mounting boss.

16. The headband ratchet mechanism of claim 12 wherein at least one leg extends parallel with the axis of rotation from the spring to the ratchet gear, the at least one leg non-rotatably connecting the spring and ratchet gear for conjoint rotation of the spring and ratchet gear.

17. The headband ratchet mechanism of claim 12 wherein the knob has lost motion with respect to the pinion gear when each individual drive member of the at least one drive member is rotating between the first and second portions of the individual pawl arm of the at least one pawl arm associated with the individual drive member.

* * * * *